United States Patent [19]

Blenkarn et al.

[11] 3,976,021

[45] Aug. 24, 1976

[54] INSTALLATION OF VERTICALLY MOORED PLATFORM

[75] Inventors: Kenneth A. Blenkarn; William D. Greenfield, both of Tulsa, Okla.

[73] Assignee: Standard Oil Company (Indiana), Chicago, Ill.

[22] Filed: Sept. 8, 1975

[21] Appl. No.: 611,286

[52] U.S. Cl. ..... 61/89; 114/.5 D

[51] Int. Cl.[2] ..... B63B 35/44

[58] Field of Search ..... 114/.5 D; 61/46.5

[56] References Cited

UNITED STATES PATENTS

| | | | |
|---|---|---|---|
| 3,154,039 | 10/1964 | Knapp | 114/.5 D |
| 3,648,638 | 3/1972 | Blenkarn | 114/.5 D |
| 3,710,580 | 1/1973 | Mott | 61/46.5 |
| 3,780,685 | 12/1973 | Horton | 114/.5 D |
| 3,902,843 | 9/1975 | Genini et al. | 61/46.5 |

*Primary Examiner*—Stephen G. Kunin
*Assistant Examiner*—Stuart M. Goldstein
*Attorney, Agent, or Firm*—John D.. Gassett

[57] ABSTRACT

This invention relates to the installation of a Vertically Moored Platform and equipment and apparatus used in effecting such installation. The floating structure, anchored only by essentially parallel and vertical elongated members under tension, is positioned with a gravity base over the subsea well site. The gravity base is lowered from engagement with the floating structure with cables to the sea floor while maintaining the floating structure in a positive buoyancy state. A large-diameter drive pipe is inserted through each receiving passage in the gravity base and into the soil or rock beneath the gravity base where it is anchored. A conductor is inserted through the drive pipe and anchored or cemented to the soil or rock beneath the drive pipe. A riser pipe is then inserted into the drive pipe and secured to the conductor. The upper end of the riser pipe is secured to the floating structure. Up to 32 or more such risers are connected between the floating structure and the gravity base. The riser pipes are then placed under tension and the cables used to lower the gravity base are then removed. Drilling operations then proceed through each of the risers. Modification of this installation and equipment necessary therefor are described.

10 Claims, 20 Drawing Figures

INSTALLATION OF VERTICALLY MOORED PLATFORM

BACKGROUND OF THE INVENTION

1. Field of the Invention

This invention relates to the installation of a structure floating on a body of water and the equipment necessary for such installation. More particularly, the invention relates to a floating structure from which drilling or production operations are carried out. It relates especially to the installation of Vertically Moored Platforms in deep water.

In recent years there has been considerable attention attracted to the drilling and production of wells located in water. Wells may be drilled in the ocean floor from either fixed platforms in relatively shallow water or from floating structures or vessels in deeper water. The most common means of anchoring fixed platforms includes the driving or otherwise anchoring of long piles in the ocean floor. Such piles extend above the surface of the water and support a platform attached to the top of the piles. This works fairly well in shallow water; but, as the water gets deeper, the problems of design and accompanying costs become prohibitive. In deeper water it is common practice to drill from a floating structure.

In recent years there has been some attention directed toward many different kinds of floating structures. One system receiving attention for mooring is the so-called Vertically Moored Platform. Such a platform is described in U.S. Pat. No. 3,648,638, issued Mar. 14, 1972, Kenneth A. Blenkarn, inventor. Key features of the disclosure in that patent are that the floating platform is connected to an anchor only by elongated parallel members and the floating structure has buoyancy means designed especially with respect to the trough of a design wave so as to minimize mooring forces imposed on the vertically elongated members which anchor the structure, such as those forces which may be caused by passing waves.

The closest or most pertinent prior art of which we are aware is the aforesaid Pat. 3,648,638. However, the installation here and the modification of the equipment for the installation are considered improvements over the installation method and system described in that patent.

BRIEF DESCRIPTION OF THE INVENTION

Briefly, a preferred embodiment of this invention concerns a Vertically Moored Platform having limited lateral movement for use in a body of water. The floating structure including a deck is set on a gravity base and the two are floated as a unit to the selected location. The gravity base is lowered by cables from the floating structure to the ocean floor. The gravity base is filled with a heavy fluid or other ballasting material and the lowering cables serve as temporary anchoring members between the gravity base and the floating structure.

The gravity base has a plurality of vertical openings therethrough and through which large-diameter drive pipes are inserted and driven, jetted, or otherwise forced into the soil below the gravity base. A marine conductor casing is inserted through the drive pipe and anchored beneath the gravity base. Large-diameter riser pipes, e.g., 20 inches or more, are then connected between the floating vessel or structure and the marine conductor or drive pipe. The riser pipes are then placed under tension and the tension on the lowering cables is then released so that these can be removed and will not be in the way of subsequent operations.

Spacing means are provided to keep the riser pipes of each leg in a fixed horizontal position relative to each other. In a preferred embodiment the spacer means are mounted on the gravity base between the gravity base and the structure before the structure is floated into position. Then, as the gravity base is lowered, the riser separators are picked off the gravity base one at a time as the barge is lowered. This is accomplished by tying the separators to deadlines to prevent rotation and assume proper alignment.

Drilling operations are conducted through the riser pipes. Subsequently, production operations are carried out through the same riser pipes.

A better understanding of the invention may be had from the following description taken in conjunction with the drawings, in which

DRAWINGS

DETAILED DESCRIPTION

Figure 1:
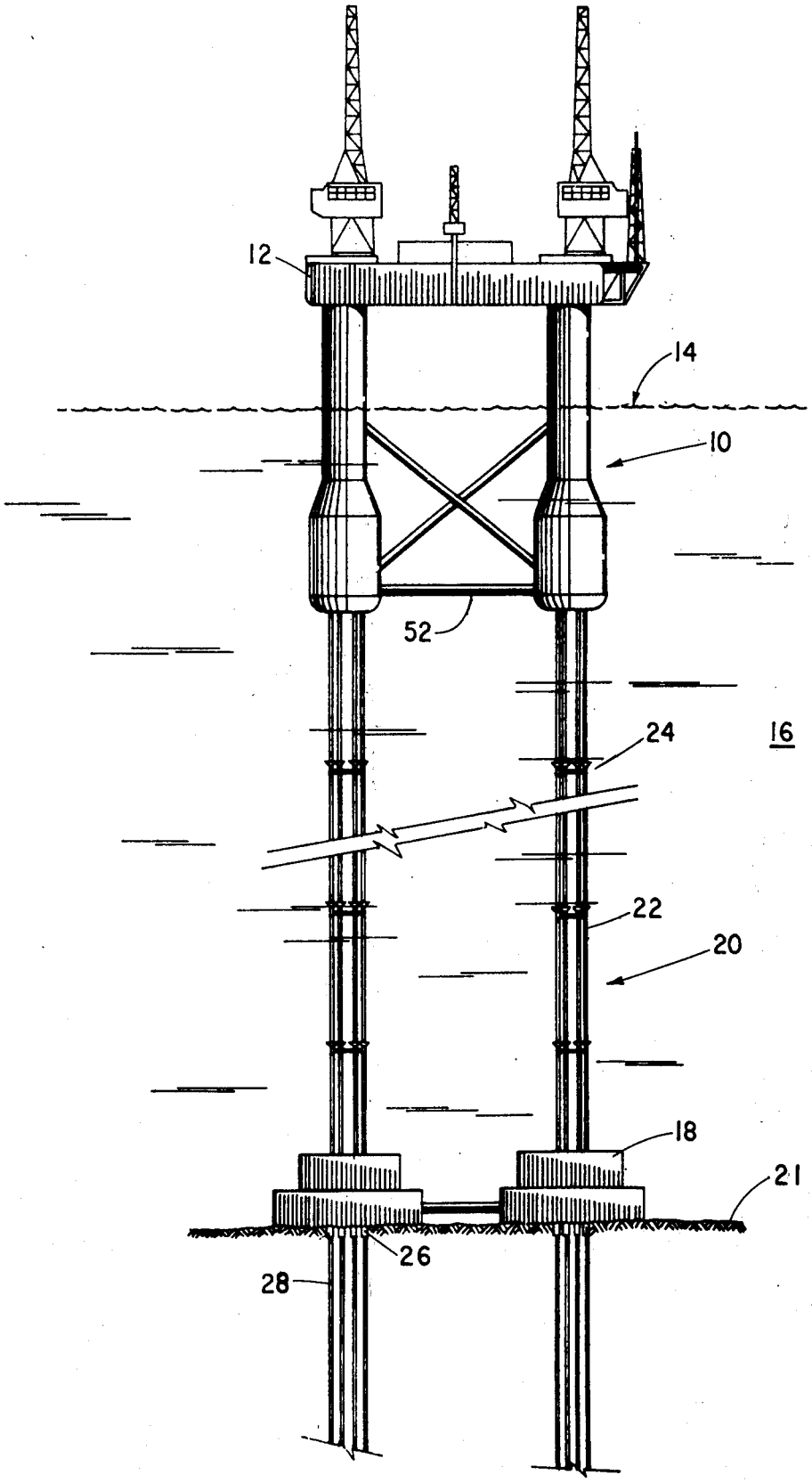
FIG. 1 illustrates a Vertically Moored Platform after installation.

Attention is next directed to the drawings, and, in particular, FIG. 1, which illustrates a Vertically Moored Platform with gravity base and risers installed and ready for drilling. There is shown a buoyancy means 10 supporting a deck 12 above the surface 14 of the body of water 16. The buoyancy means 10 is connected to gravity base 18 by four legs 20. Each leg 20 includes a plurality, in this case, eight, of riser pipes 22. Spacers 24 are provided vertically along each leg 20 to keep the riser pipes 22 apart and to modify their resonant frequency to prevent flutter. Each gravity base section 18 has a plurality of punch tubes 26 which are forced by the weight of the gravity base into the sea floor 21. Drive pipes 28 extend downwardly from punch tubes 26. After the Vertically Moored Platform is installed, as shown in FIG. 1, drilling operations are conducted through individual risers 22 from the top of platform 12. The rest of the figures in the drawings are useful in explaining how the installation of the Vertically Moored Platform of FIG. 1 is effected.

Figure 5:
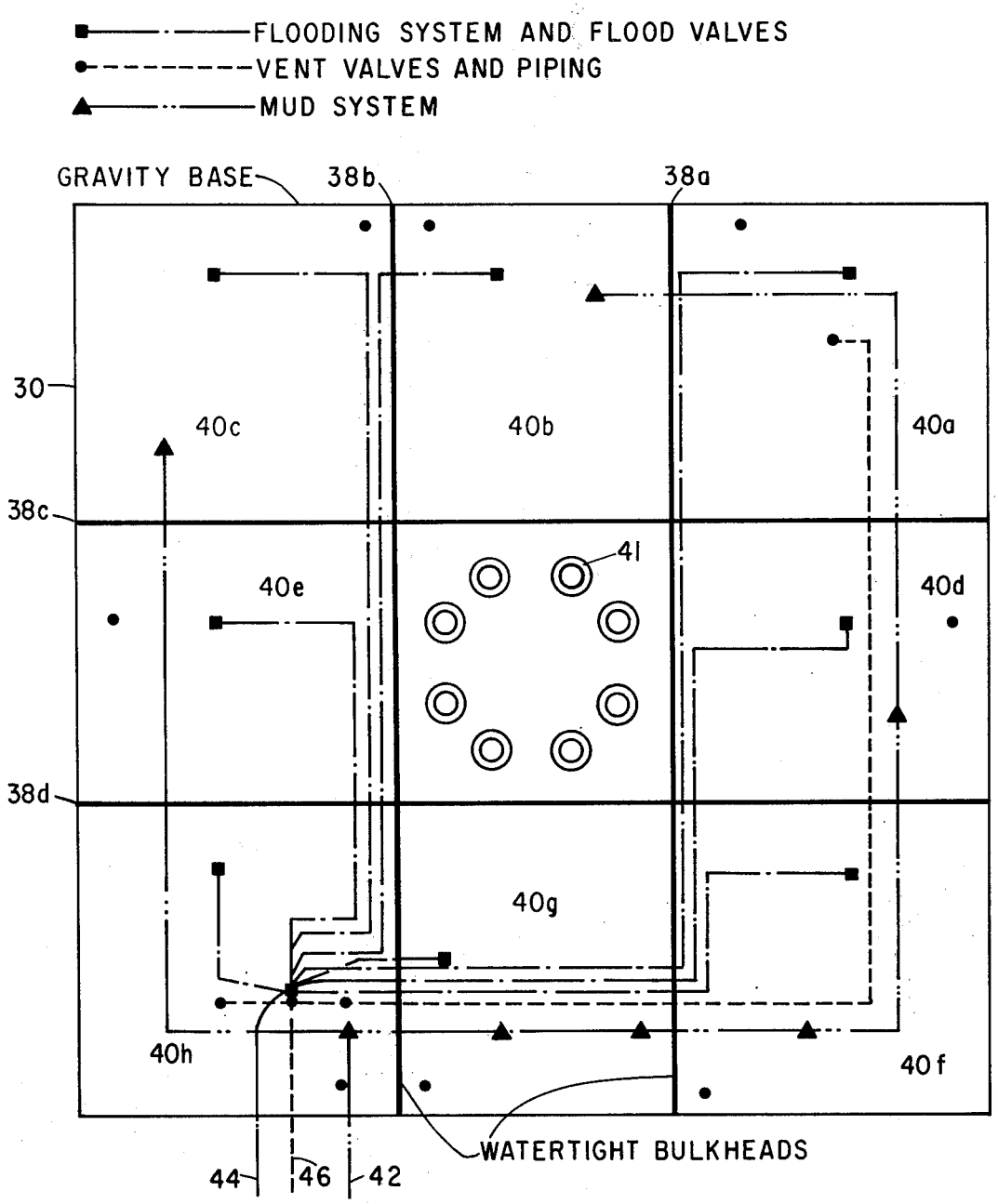
FIG. 5 is another plan view of one section of the gravity base of FIG. 3 showing inner compartments and flooding system.

The Vertically Moored Platform of FIG. 1 must be transported to its desired location. The preferred way of transporting it is to tow it in a floating condition. This can be done in a manner illustrated in FIG. 2. The platform 12 and buoyancy means 10 are supported above the surface 14 of the body of water 16 by gravity base 18. As can be seen in FIG. 3, gravity base 18 has four sections 30, 32, 34, and 36, connected by suitable cross bracings. Each gravity base section 30, 32, 34, and 36 can be considered a compartmentalized tank. As shown in FIG. 5, means are provided to add water or heavy drilling mud or even unset cement to the various compartments, so as to give it the proper mass. As shown in FIG. 5, the base 30, for example, is shown having water-tight bulkheads 38*a*, 38*b*, 38*c*, and 38*d*. These water-tight bulkheads form compartments 40*a* through 40*h*. There is a mud system 42, a waterflooding system 44, and a vent valve and piping system 46. Controls on flowlines extend to a supporting work boat at the surface, so that any one or all of the various compartments can be vented, flooded, or have a drilling mud added thereto. A drilling mud is usually water which has solids added thereto to make it heavier. The center compartment has vertical passages 41 extending therethrough. As will be seen, it is through these passages 41 that casing, etc., are inserted into the ground. It is also through these that the lower ends of the riser pipes are connected.

Figure 2:
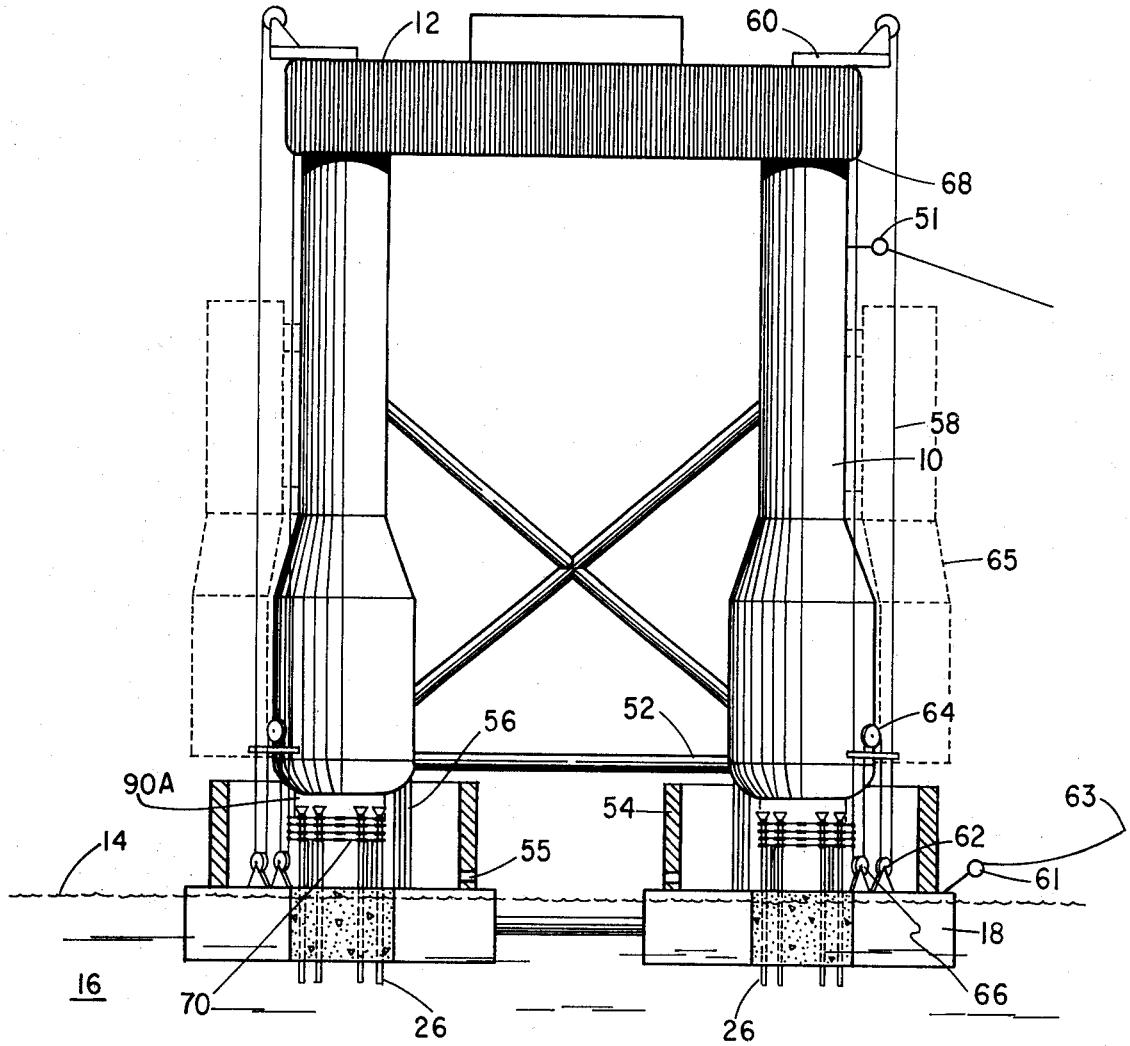
FIG. 2 illustrates the towing position of the Vertically Moored Platform supported on a gravity base with auxiliary buoyancy tanks attached to the jacket.
Figure 3:
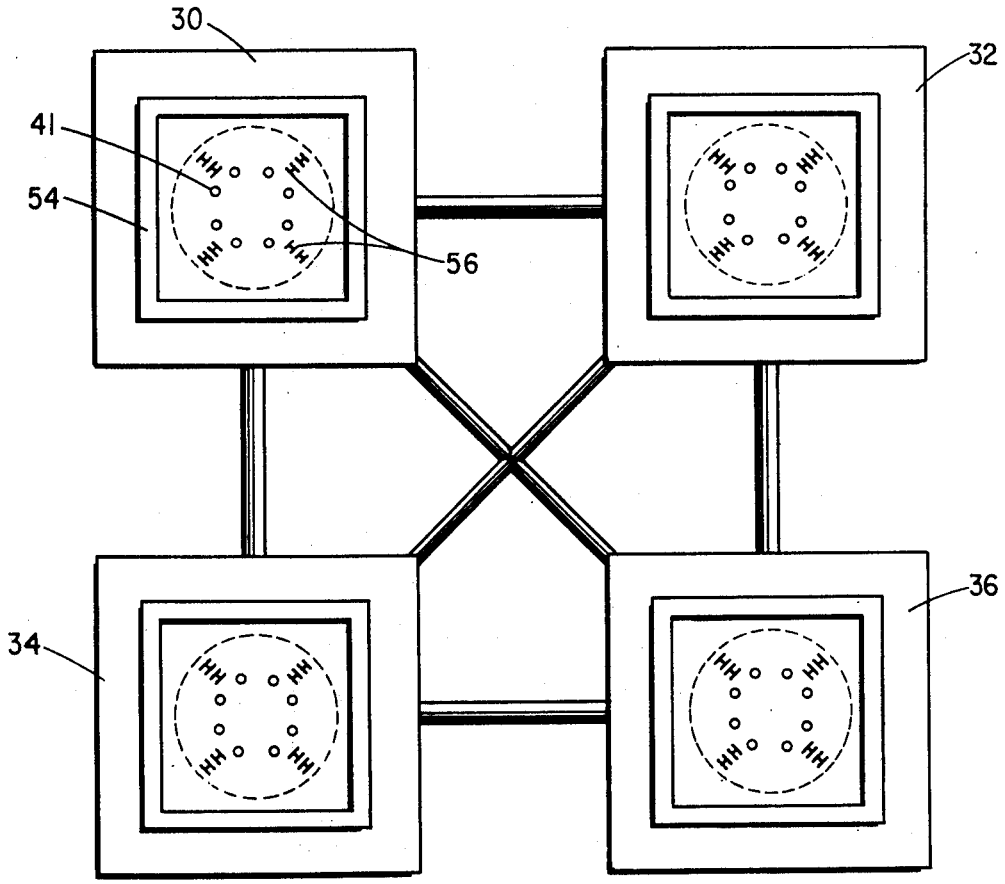
FIG. 3 illustrates a plan view of a gravity base showing sections of the gravity base corresponding to the four legs of the Vertically Moored Platform of FIG. 1.
Figure 4:
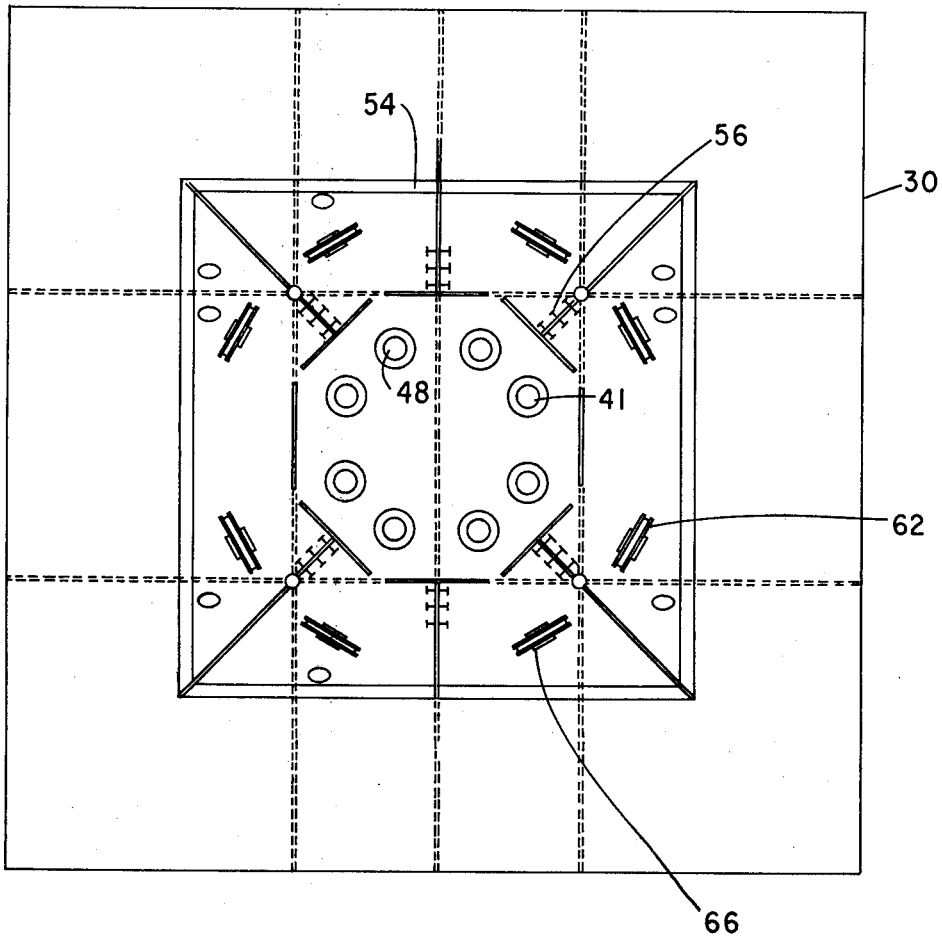
FIG. 4 shows a plan view of one section of the gravity base showing more details than FIG. 3.

Attention is now directed back to FIG. 2, in which the buoyant members 10 are supported by supports or cradles 56. There may be three, four, or more cradles per leg. A line 58 extends from winch 60 on top of deck 12 to sheave 62 on gravity base 18 back to sheave 64 on buoyancy means 10, back under a sheave 66, which is adjacent sheave 62, and back to the surface where it is tied at point 68 to platform 12. There is preferably a plurality of such lines and sheaves, normally four. The arrangement of sheaves 62 and 66 on each section of the gravity base is shown in FIG. 4. Centralizers 24 are stacked within enclosure 54. These centralizers will be discussed in more detail later. The enclosures 54 are provided with holes 55 so that during lowering of the gravity bases 18 water can flood the interior of enclosure 54.

The size of the structure illustrated in the drawings will vary from location to location and will depend upon many factors, such as the sea conditions expected, the number of wells expected to be drilled from the platform 12, the depth of the drilling, etc. However, typically, one might expect that deck 12 would be square-shaped, having dimensions of about 200 by 200 feet (61 to 61 meters). The height of deck 12 from the base of buoyancy means 10 is about 240 feet (73 meters). Typically, each leg of buoyancy means 10 has a displacement of about 7350 tons. The size of each gravity base in FIG. 3 for each leg is typically about 100 feet (30 meters) square and 24 feet (7 meters) high.

As mentioned in the device of FIG. 2, it is towed by suitable towing tugs connected to padeye pilot 61 in gravity base 18.

Upon arrival at the well site, the tow lines 63 are released and the structure is allowed to float free. What we wish to do is to lower the gravity bases 18 to the bottom 21. This can be accomplished in various ways. However, it is believed that the following system generally gives the best stability to the operation. In this procedure, the tiedowns from the gravity base to the jacket and riser spacers are released. This can be done in any convenient manner, the details of which are not shown. Inasmuch as the gravity base 18 and the buoyancy means 10 are soon to be separated, the buoyancy means 10 must be lowered into the water where they can effectively support platform 12. It is not believed desirable to try to lower the four legs of the buoyancy means 10 in a level manner. The reason for this is that in any kind of wave action of the sea it would be most difficult to do and the buoyancy means 10 would become quite unstable and would tilt to one side or the other. Auxiliary buoyancy tanks 65 may be added on each leg, as shown in FIG. 2, to provide additional stability. Inasmuch as it is considered highly likely that the platform would tilt in one direction or another under any condition, the location of the auxiliary buoyancy tanks and the sequence of ballasting is chosen to tilt the platform means in a controlled manner. After we release the tiedowns between the gravity base and the buoyancy means 10 of the Vertically Moored Platform, we tension the lowering cables 58 to an appropriate value, for example, typically, 100 kips exerted by each winch. Typically, there would be four winches per leg of the platform. The tension is maintained on these winches during the initial lowering.

We first start ballasting gravity base sections 32 and 36, as illustrated in FIG. 3. We first start flooding compartments 40*a*, 40*d*, and 40*f*, as illustrated in FIG. 5. Partitions 38*a* to 38*d* create compartments 40*a* to 40*h* in each gravity base section. Attention is next directed to FIG. 6, which shows a typical sequence of steps A through M of flooding to obtain a controlled mooring under gravity bases. This flooding is continued until we reach a tilt of about 17°, as indicated in step C. We next start flooding all of the compartments, as illustrated in steps D and E. When we get to step E, we have reached a tilt of nearly 20 degrees, which is about the maximum we desire to obtain. Continued flooding of all of the compartments gradually brings the tilt back to zero. The sequence of these steps is illustrated in steps F, G, and H. When we get to H, we are back to no tilt at all, i.e., a level condition. Before this lowering of the gravity base and platform, the tow lines from the tugs are disconnected from padeyes 61 and may be connected (with slack) to the padeyes 51 (FIG. 2), which are located high on the legs, which would be about five feet or so above the still-water line when the device is completely lowered. These remain in place during the lowering of the gravity base. Water is continually added to the various compartments to bring the device through steps I, J, and K. K represents the position when the desired still-water level is reached on the legs of buoyancy means 10. At this time, mud, which is a heavy drilling fluid, may be added to the gravity base through displacement of the ballast water. This is accomplished by manipulating the control lines 42, 44, and 46, illustrated in FIG. 5. No details of the exact operations will be given, as it is apparent how to do it once the problem is set forth. We then continue lowering the base 18 until it reaches the bottom of the ground at the bottom of the bed of water, as shown in step M. We add ballast to buoyancy means 10, as required, and apply the proper tension on the cables, using winches so that the final jacket draft is whatever is selected, which typically might be about 150 feet.

Figure 6:
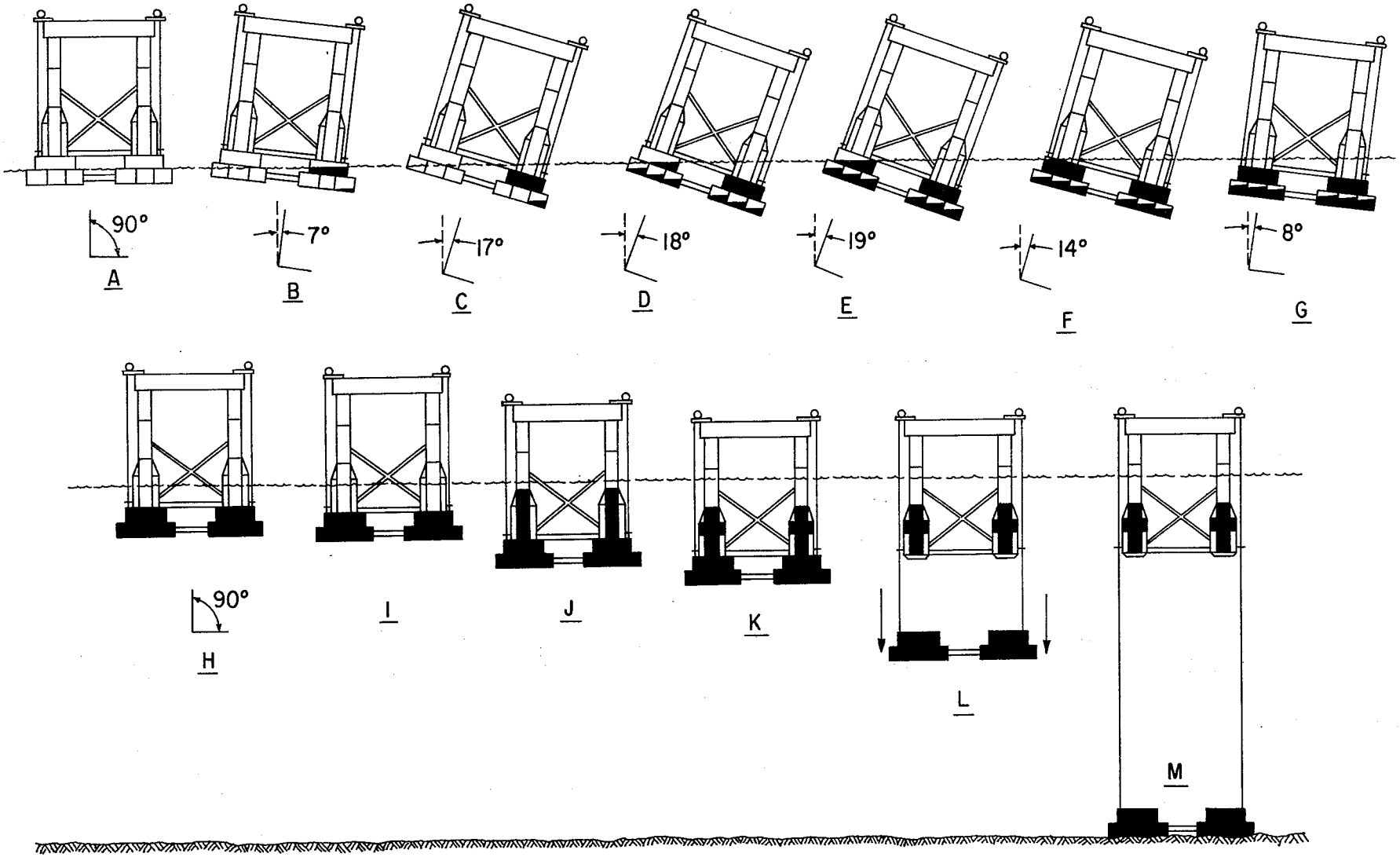
FIG. 6 shows a sequence of positions of the Vertically Moored Platform during installation of the gravity base.
Figure 7:
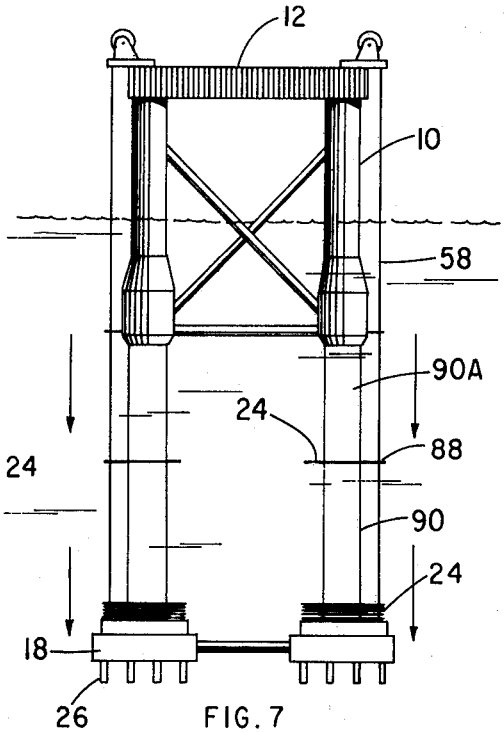
FIG. 7 shows the gravity base partially lowered and with one riser spacer or centralizer in position.
Figure 8:
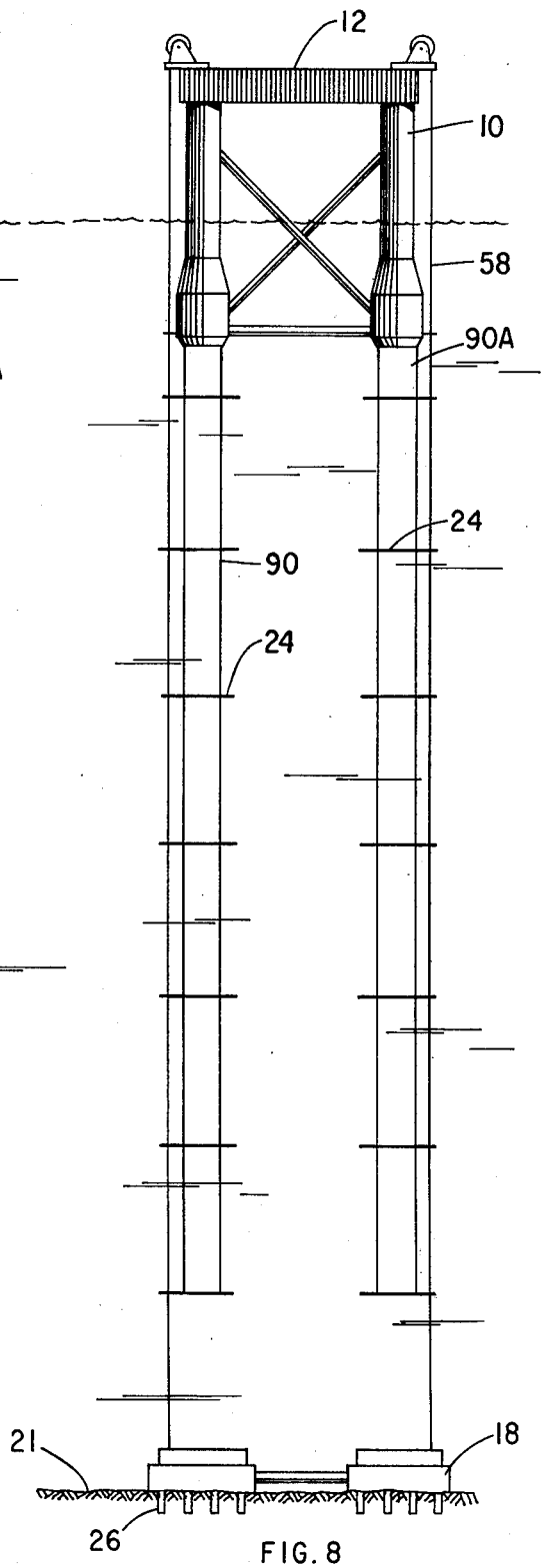
FIG. 8 illustrates the Vertically Moored Platform with the gravity base on bottom and connected to each other by cable.
Figure 12:
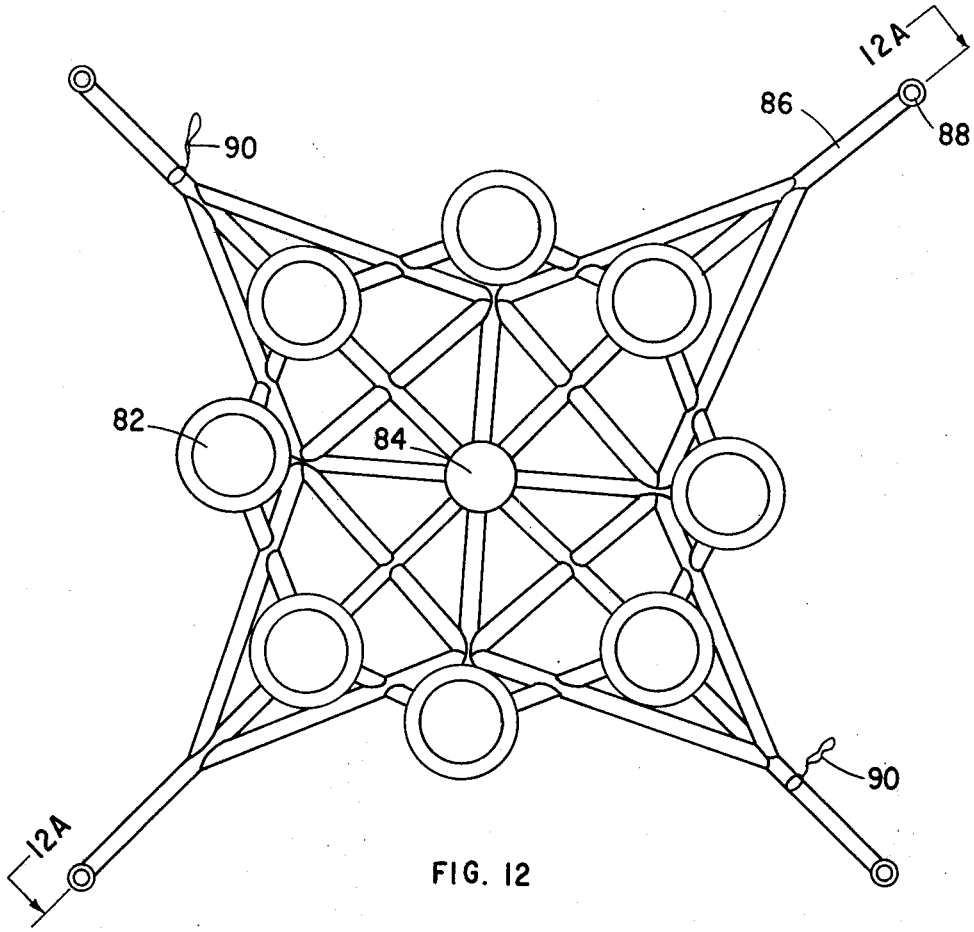
FIG. 12 illustrates a plan view of a centralizer or spacers for one leg of the Vertically Moored Platform and FIG. 12A illustrates a section along 12A—12A of FIG. 12.
Figure 12A:
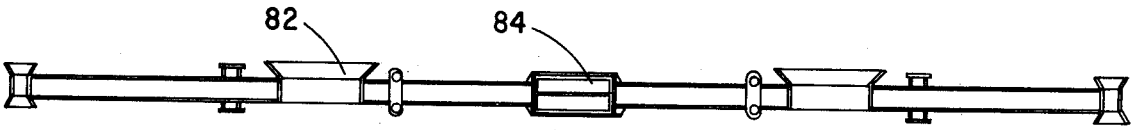

In connection with FIG. 6, we discussed the lowering of the gravity base. No mention was made of the lowering of the riser spacers which occurs simultaneously. A brief discussion will now be made of the centralizers and how they are lowered. Attention is next directed to FIGS. 7, 8, and 12. As shown in FIG. 2, the riser spacers are stacked within the enclosure wall 54 of the gravity base 18. FIG. 12 shows a plan view of a spacer assembly. There is one group of such spacers for each of the four legs of the platform. Each spacer includes a plurality of vertical passages 82, which are spaced in more or less a circle about the center of the spacer 84. There are four arms 86 which extend outwardly from center 84. These arms terminate in a ring 88. As shown in FIG. 7, tension cables 58 pass freely through rings 88. As can be seen in FIG. 2, the spacers of FIG. 12 are stacked one on top of the other. They are connected by spacing lines 90, which permit the spacers to hang in a vertically spaced relationship as the gravity base 18 is lowered to the floor 21. These hang spaced apart more or less like a Venetian blind. As can be seen in FIG. 8, then, we have a platform 12 supported by buoyancy means 10, which is anchored by lines 58 to the gravity base 18 which rests on the bottom 21. Riser spacers 24 are positioned all along lines 58 at the desired locations and that point is determined by the length of the line segments 90. Spacers 24 are shown equally spaced vertically but can be at any desired spacing, which may be different for the different depths of water. The riser pipes are not installed yet at the stage of progress shown in FIG. 8. We can modify the operation for vertical positioning of the spacers. We can lower all spacers with the gravity base until it reaches bottom. This can be accomplished by making line segment 90A long enough to reach from buoyancy means 10 to the bottom and then pull up on line segment 90A until the spacers are in the position shown in FIG. 8.

Figure 9:
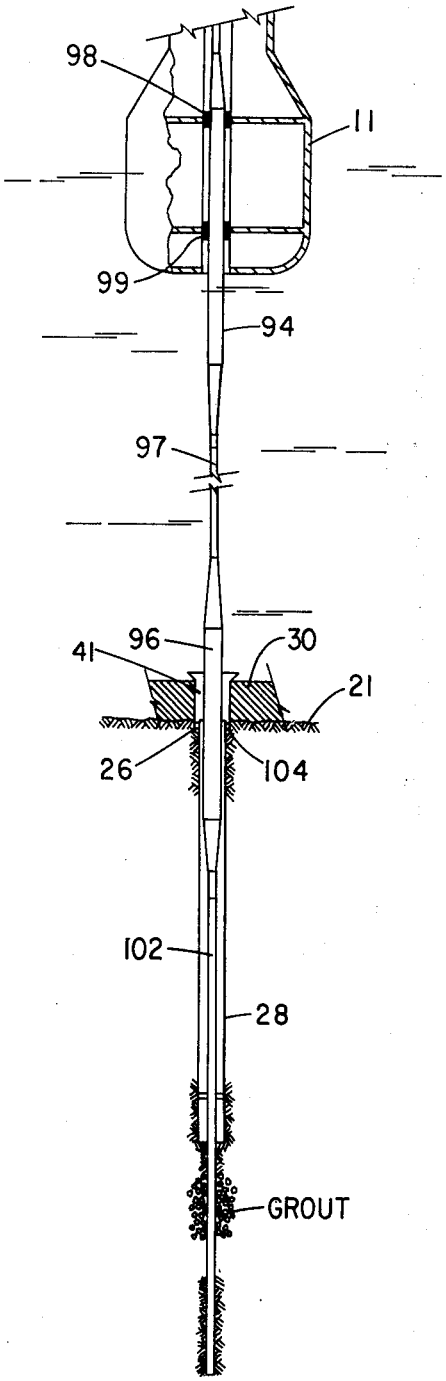
FIG. 9 shows one riser including upper and lower terminations extending from one of the buoyant means of the platform to the ocean floor.
Figure 10:
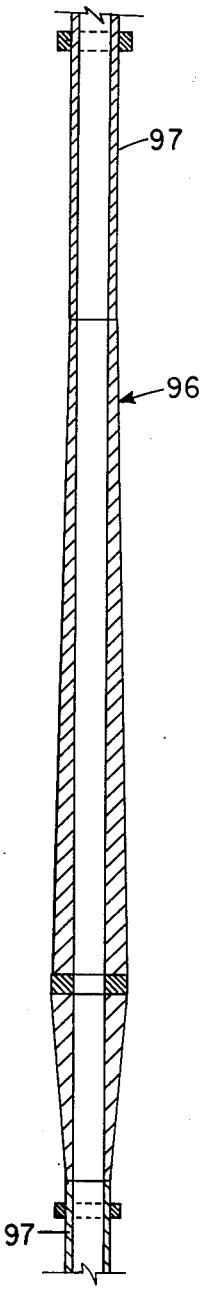
FIG. 10 illustrates a lower terminator of the riser.
Figure 11:
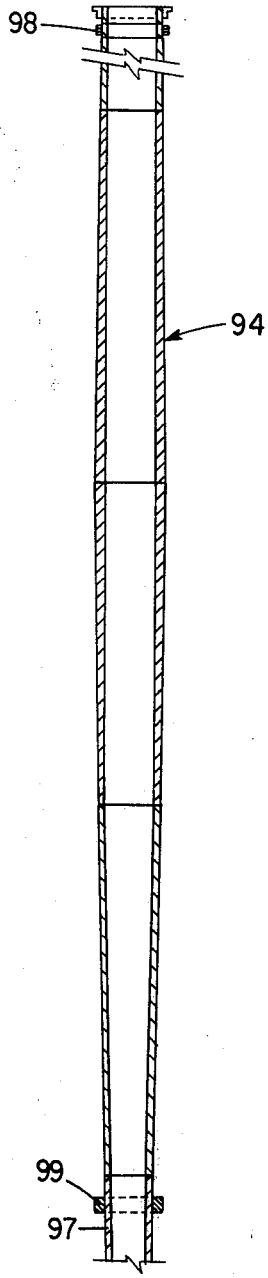
FIG. 11 illustrates an upper terminator of the riser.

We shall next discuss the installation of the riser pipes and removal of tension cables 58, so that we have an assembly such as shown in FIG. 1. Attention is next directed to FIG. 9, which shows one typical riser pipe extending from one leg of buoyancy means 10 through gravity base section 30, resting on the bottom 21. This includes an upper terminator section 94, and a lower terminator section 96 which extends through vertical opening 41 of gravity base section 30. Opening 41 is funnel-shaped at the top to aid in guiding the riser pipes. It is known that if a tubular member is held under tension subject to rotational movement or angular movement, stresses concentrate in the ends. One way of meeting this problem is to make the end sections sufficiently strong to withstand any stresses which may concentrate therein. That is what is done here. FIG. 10 illustrates a lower riser terminator 96, and FIG. 11 illustrates an upper riser terminator 94. In FIG. 10, the standard part of the riser 97 is shown as the regular riser which is normally about 20 inches in diameter. The terminators have this thickness of the wall increased to withstand the stresses which may be encountered. The stresses which may be encountered will be determined by a number of factors, such as the depth of the water, the length of the riser pipe 97, the currents, the waves, etc. These concentrations of stresses can be determined by standard engineering principles. The thickness of the terminators is selected for the particular material so that the concentration of stresses so determined is acceptable.

The upper terminator 94 bears upon jacket 11 by two horizontal bearings 98 and 99. Means of applying vertical tension to the riser pipe will be discussed in relation to FIGS. 17 and 18. The lower riser terminator 96 extends down through punch tubes 26 and drive pipe 28. The lower end of riser pipe lower terminator 96 is connected to a conductor casing 102 which is about the same diameter as riser pipe 97. The lower terminator has a reasonably close fit inside the drive pipe.

Figure 15:
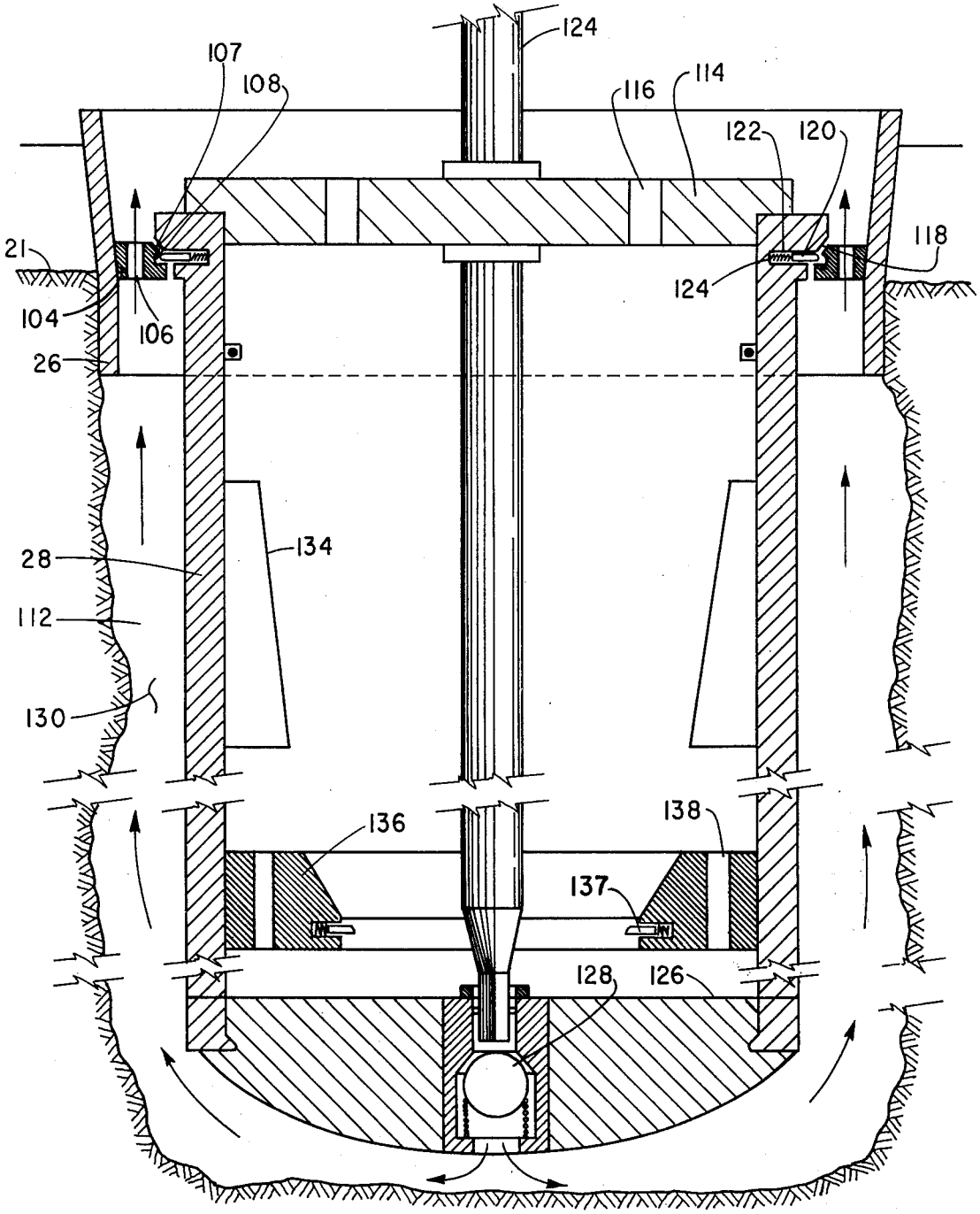
FIG. 15 illustrates one means of lowering the drive pipe into the hole and into locking engagement with the gravity base.

Attention will next be given to means of setting the drive pipe. In this regard, attention is directed to FIG. 15, which shows the lower end of punch tube 26 which extends below the bottom 21. A ring 104 is fastened to the punch tube 26 and is provided with a plurality of vertical holes 106. The inner face of the ring 104 is sloping downwardly and has a blocking groove 108. A hole 112 is either washed out or drilled out below punch tube 26 for the drive pipe 28. The hole 112 for the drive pipe 28 can be made in any known manner. Shown in FIG. 15 is a lowering tool 114 which has vertical ports 116. The lowering tool 114 is connected to the drive pipe 28. The upper end of drive pipe 28 is provided with a downwardly facing shoulder 118 which complements shoulder 107 of ring 104 of the punch tube. A locking ring or pin 120 is provided in a groove 122 within the upper shoulder of the drive pipe and ejection spring 124 is provided to force the ring 120 outwardly. As the drive pipe is lowered downwardly through ring 104, ring 120 is compressed inwardly. Once the locking groove or ring 108 has reached the pin, ring 120 snaps out into locking engagement. The lowering tool 114 is lowered on a string of drill pipe 124. The lower end of the string of drill pipe has a closure 126, having check valve 128. It is desired to cement the drive pipe 28 in place, so a cementing slurry is pumped down through drill string 124 past check valve 128 and up into the annulus 130 with returns through port 106. Drive pipe 28 may contain centering ribs 134 for the lower terminator of the riser pipe and it also includes a mudline suspension element 136 having vertical ports 138 for subsequent cement circulation. Conductor casing 102 is secured to drive pipe 28 by any suitable means such as by latching ring 137.

Once the drive pipe is in position, we remove the lowering tool 114. We then go in with a drill bit on the lower end of drill pipe 124 and drill out drillable closure 126. We then continue drilling until we have drilled a sufficient depth of hole to take care of the required length of conductor casing which will be about the same size as riser pipe 97 which will normally be about 20 inches.

Figure 16:
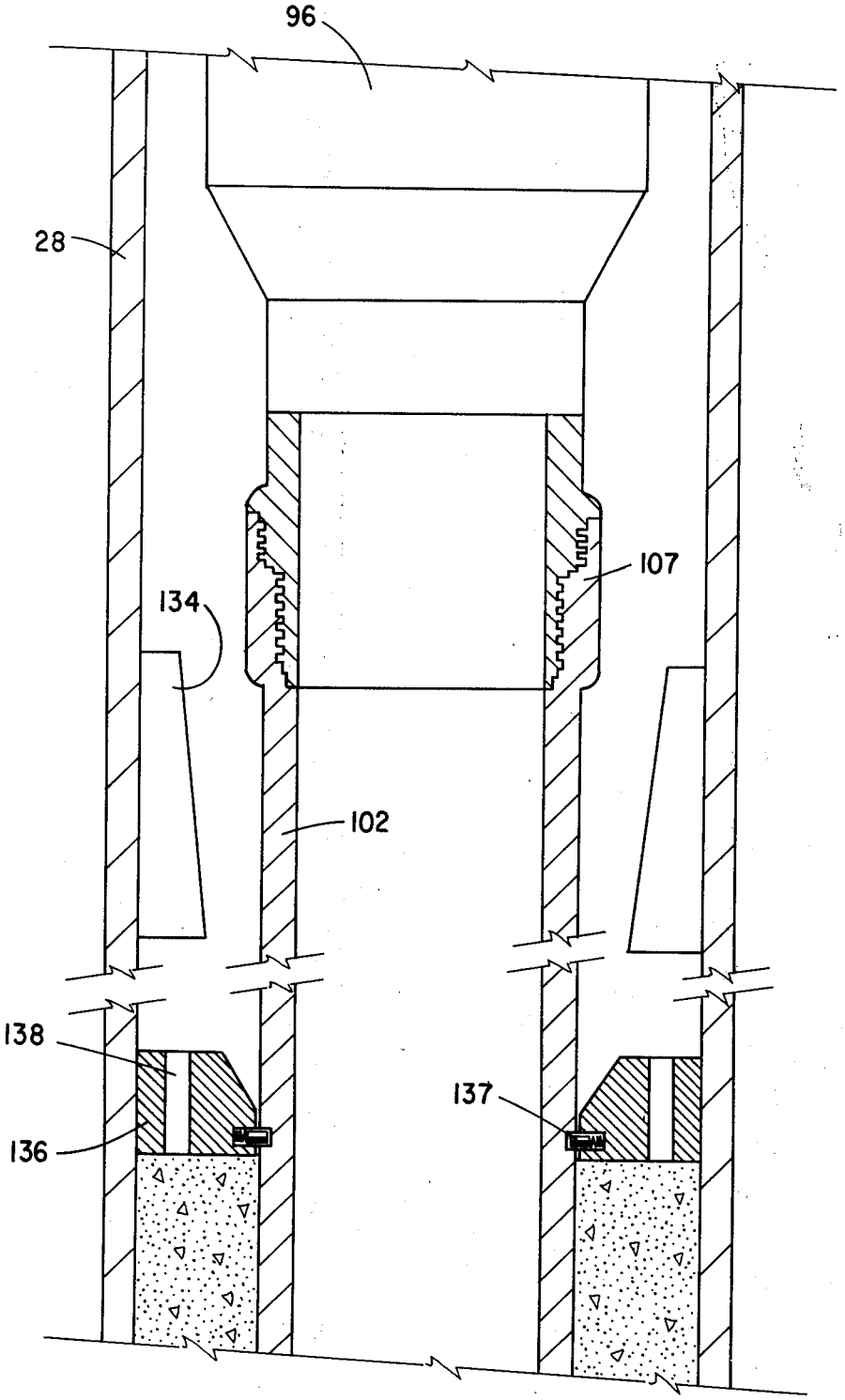
FIG. 16 illustrates a connection of the lower terminator of the riser with a conductor pipe in the drive pipe beneath the gravity base.

The 20-inch casing then is run and seated on mudline suspension 136. We provide locking means such as ring 137 on this, too, to prevent upward movement, as seen more clearly in FIG. 16. The 20-inch casing is then cemented in place. If the 20-inch casing is set deep enough, it can be the primary anchoring means.

Figure 13:
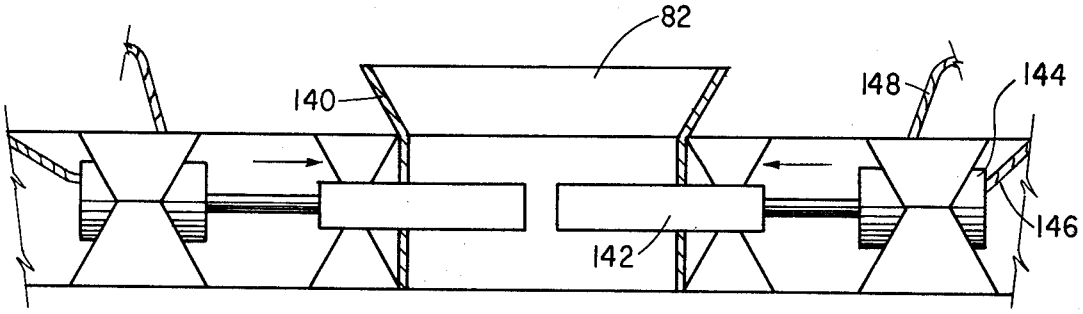
FIG. 13 illustrates one passage in the spacer of FIG. 12 and means for securing the spacer to the riser.

At this point, we are ready to run riser pipe 97. As is apparent from FIGS. 9, 10, and 11, the riser terminators, the end portions, that is, are larger than the main part of the riser pipe. We have to make the holes in the spacers 24 large enough to accommodate the larger diameters of the drive pipes rather than just the diameter of the main part of the riser pipe itself. FIG. 13 illustrates one vertical opening 82 in the spacers of FIG. 12. The upper end of passage 82 has enlargement or funnel 140 which aids in stabbing the risers through the openings 82. Mounted adjacent the vertical passage 82 are a pair of rams 142 driven by hydraulic motors 144. Hydraulic motors 144 can be double-acting so that rams 142 can be driven either in or out in relation to the hole 82. Hydraulic power through one hydraulic line 146 drives it in and through line 148 drives it out. The inner surface of rams 142 is curved to give a reasonable fit, but not necessarily a tight one, with the portion of the riser pipe in poet 82.

Figure 14:
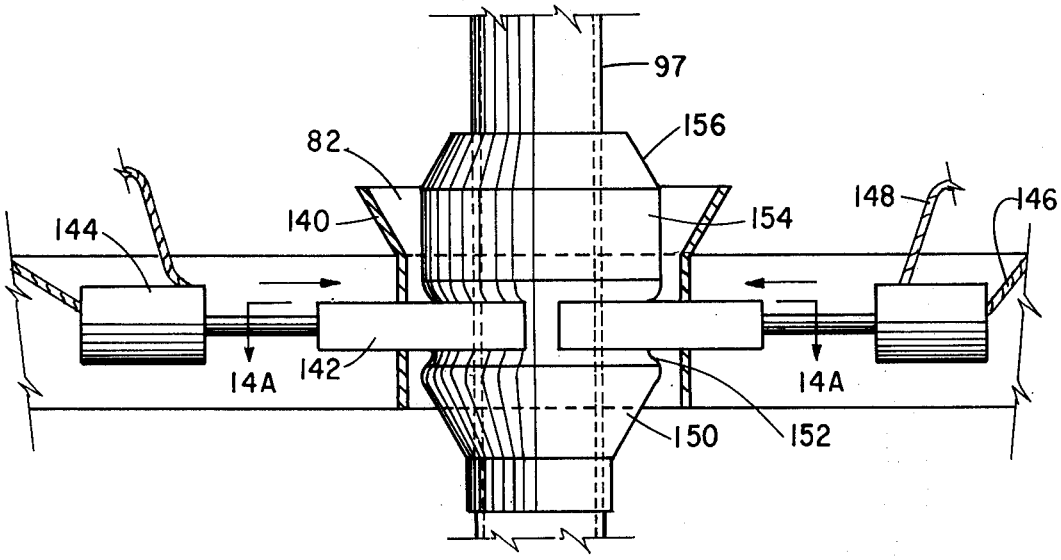
FIG. 14 illustrates the riser pipe held in position within one opening of the spacer of FIG. 12
Figure 14A:
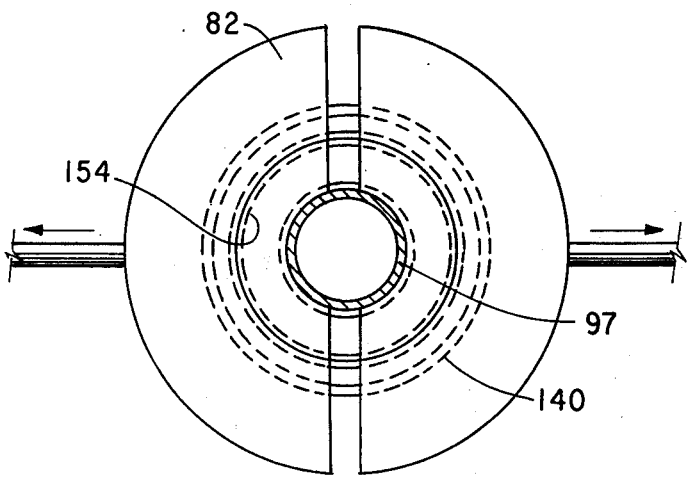
FIG. 14A illustrates a section along line 14A–14A of FIG. 14.

Attention is next directed to FIG. 14. This is similar to FIG. 13, except it illustrates a portion of the riser pipe extending through passageway 82 and held in position by rams 142. The portion of the riser pipe here is enlarged by a body 154 having a lower upwardly facing or sloping shoulder 150 with a groove 152 just above that. It is in this groove 152 that rams 142 are driven by hydraulic motor 144. The body of 154 is made preferably of some epoxy resin to minimize wear on the riser pipe 97 itself. The upper part of the body 154 has an upwardly facing shoulder 156 to help guide the riser pipe through the passage 82 in the spacer just above the spacer under consideration in the event it is desired to remove the risers. Attention is now directed to FIG. 14A which shows a cross section along the line 14A—14A of FIG. 14. This shows that rams 142 do not have to contact each other and can have a loose fit within groove 152 so that the riser pipe can rotate with respect to the rams without imparting moments. The riser pipe is lowered down through all of the centralizers and comes to position adjacent the upper end of the conductor casing 102. It is desired that the riser pipe be securely and suitably connected to the conductor. It is also desired, but not absolutely essential, that the riser pipe be connected in such a manner that it can be readily disconnected from the conductor casing. This can be accomplished by using a Non-Cross threadable casing connection. This is illustrated as 107 in FIG. 16. A Non-Cross threadable surface casing connection is illustrated in Bulletin No. 1058, the Hydril Company, 714 West Olympia Boulevard, Los Angeles, California.

Figure 17:
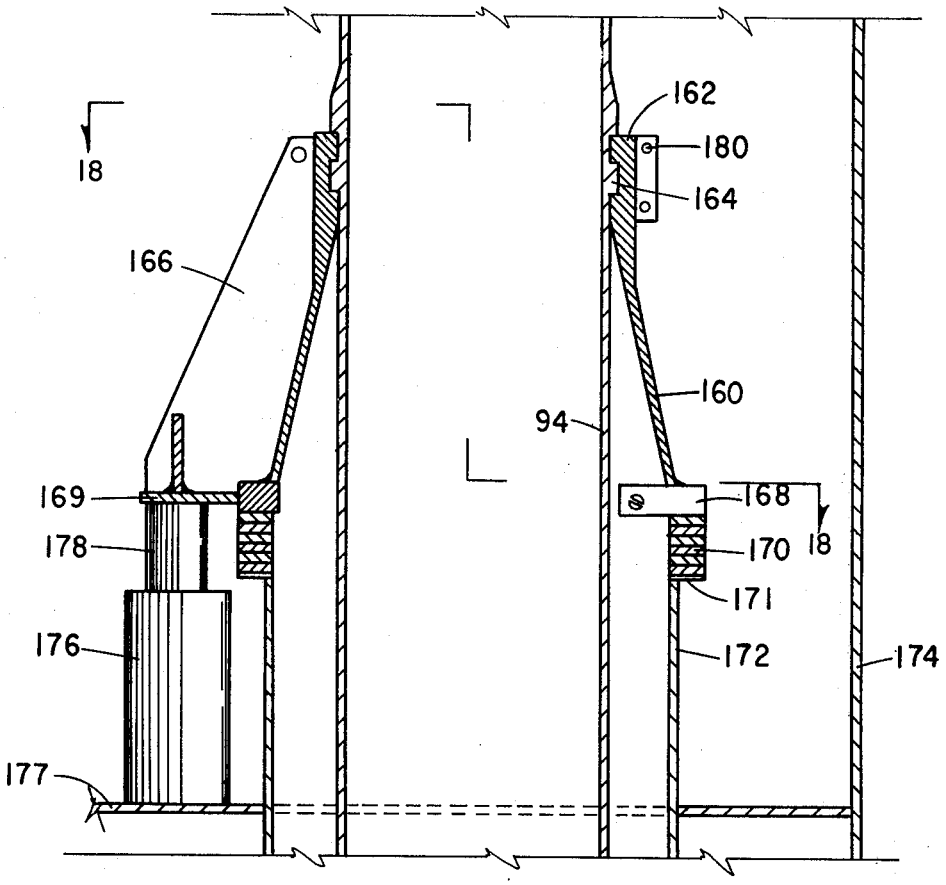
FIG. 17 is taken along the line 17—17 of FIG. 18 and illustrates a method of applying tension to the riser pipe and located within the buoyancy means.
Figure 18:
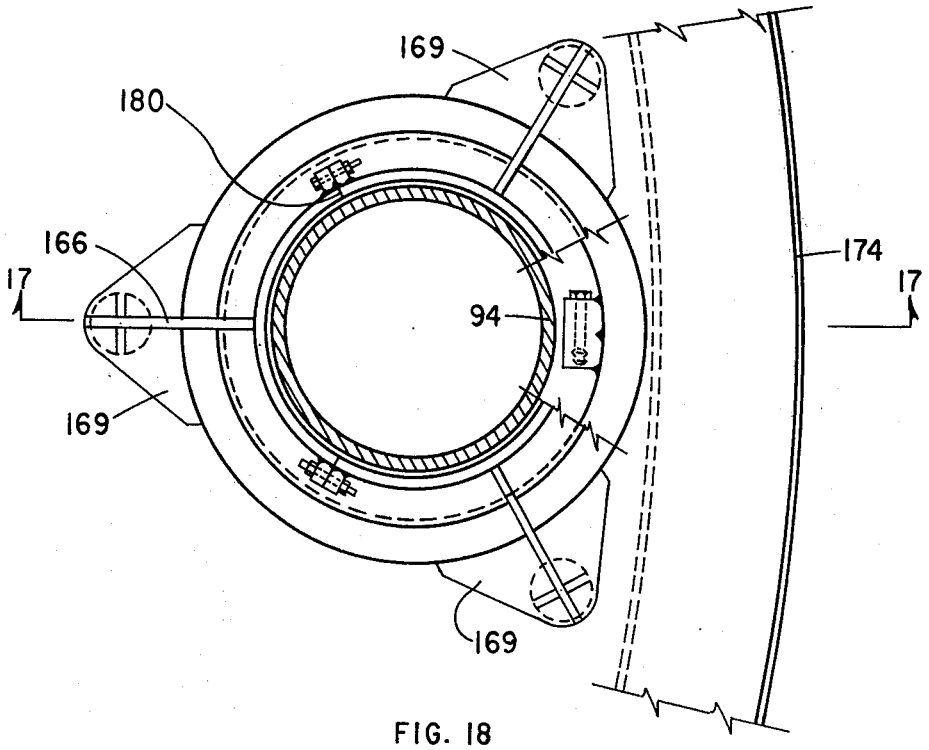
FIG. 18 is a view taken along the line 18—18 of FIG. 17.

Attention is now directed to FIGS. 17 and 18 which show means for applying tension to the riser pipes. By this system, we can adjust the tension as desired. Shown thereon, is the riser pipe upper terminator 94 extending upwardly through jacket 174. An outer shoulder 164 is provided about the upper portion of the riser pipe 94, shown in FIG. 17. A complementing bracket 162 is mounted about ring 164. Bracket 162, as can be seen in FIG. 18, is made in three pieces and connected together by bolts or other connecting means 180. Element 162 extends downwardly in a tapered position to a ring member 168. 168 has three extensions, 169, as shown in FIG. 18. A jack 176, supported from bulkhead 177, which is supported from the jacket 174, is provided with a ram 178, which contacts shoulder 169. By applying force to jack 176, the risers can be pushed upwardly with respect to jacket 174. A bearing plate 171 is attached to upright member 172 which is attached to jacket 174. Shim plates 170 are provided between items 171 and 168. What occurs is that the jack 176 pushes the riser pipe upwardly, and then a sufficient number of bearings 170 is inserted, then the jack is backed off and the force is transmitted through the bearings 170. Thereafter, proper tension is applied to riser pipes 94 and cables 58 are removed. At this time, then, all of the anchoring of the buoyancy means is through the riser pipes. It is well to point out that there are a plurality of riser pipes, typically eight, in each leg, of which typically there are four in the particular embodiment shown. In this configuration there would normally be 32 riser pipes, all installed as discussed herein. Drilling and subsequent production operations can be conducted through each riser.

While the above description has been given in rather high detail, various modifications can be made without departing from the spirit or scope of the invention.

I claim:

1. A method of installing a floating structure over a location on the floor of a water-covered area in which the floating structure is anchored only by essentially parallel and vertical members under tension, which comprises:

a. positioning said structure and a gravity base over said location;

b. lowering said gravity base from said floating structure with cables to said floor while maintaining said floating structure in a positive buoyancy state;

c. after said gravity base is in engagement with said floor, lowering riser pipes and securing the lower ends to a fixed position with respect to said ocean bottom;

d. securing the upper ends of said riser pipes to said floating structure; and e. placing said riser pipes under tension and removing the tension from said cables so that said cables can be removed and then removing the cables from between said floating structure and said gravity base.

2. A method as defined in claim 1, including the steps of:

f. providing a plurality of separate groups of risers spaced from each other, each group having a plurality of risers therein; and g. providing spacers supported on cables for the risers along the vertical length of each group at selected intervals.

3. A method as defined in claim 1, including after the gravity base is positioned on said floor the steps of h. inserting a large-diameter drive pipe through a receiving passage in said gravity base into the soil beneath the gravity base;

i. and then inserting the lower end of said riser into said drive pipe; and j. repeating steps (h) and (i) for each riser selected to anchor the structure to the base.

4. A method as defined in claim 2 in which said spacers are positioned on top of the gravity base and lowered with the gravity base, then raising the spacers off the gravity base one by one to a level selected for each spacer.

5. A method as defined in claim 2 in which:

said spacers are lowered by cables at spaced intervals prior to lowering said risers.

6. A method as defined in claim 5, including the step of securing the spacers to said risers.

7. A method as defined in claim 6 in which the step (h) said drive pipe is jetted into the bottom.

8. A method as defined in claim 4 including the step of securing said spacers to said risers.

9. A method of installing a floating structure for a well site in which the floating structure comprises a plurality of buoyant bottle-shaped members in which each said bottle-shaped member is to be anchored to a gravity base section having drive-pipe ports therethrough only by essentially parallel and vertical risers under tension, which comprises:

a. placing a plurality of riser spacer members on each said gravity base;

b. releasably securing a gravity base to each said bottle-shaped member for supporting same;

c. positioning said structure, said gravity bases and spacer members over a subsea well site;

d. lowering said gravity bases and said spacers to said subsea well site from said floating structure with cables while maintaining said floating structure in a positive buoyancy state sufficient to support said base as it is being lowered;

e. inserting a drive pipe through each drive pipe port in said gravity base section and securing same to said gravity base section;

f. drilling a hole down through said drive pipe for a marine conductor;

g. running said marine conductor;

h. connecting each said marine conductor to said drive pipe;

i. cementing said marine conductor;

j. repeating operations (e) through (i) for each drive pipe and marine conductor installed on each gravity base;

k. lowering at least one riser down through each said bottle-shaped member and into engagement with a marine conductor;

l. securing the lower end of each said riser to its respective marine conductor;

m. connecting the upper end of each said riser with its respective said bottle-shaped member and applying tension to said risers;

n. relieving the tension on said cables;

o. removing the cables from between said structure and said gravity bases; and p. positioning spacers at selected elevations along the riser and then securing the spacer at each level to said riser pipe between the gravity base and the bottle-shaped members.

10. A method as defined in claim 9 which includes:

adding additional ballasting to the said gravity base after it is on bottom;

and in which the step of applying tension to said risers includes the step of deballasting the structure after said cables have been removed.

* * * * *